US010400990B2

(12) United States Patent
Connerth

(10) Patent No.: US 10,400,990 B2
(45) Date of Patent: Sep. 3, 2019

(54) LIGHT MODULE FOR A MOTOR VEHICLE ILLUMINATION DEVICE

(71) Applicant: Automotive Lighting Reutlingen GmbH, Reutlingen (DE)

(72) Inventor: Rolf Connerth, Reutlingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 0 days.

(21) Appl. No.: 16/074,995

(22) PCT Filed: Feb. 3, 2017

(86) PCT No.: PCT/EP2017/052444

§ 371 (c)(1),
(2) Date: Aug. 2, 2018

(87) PCT Pub. No.: WO2017/134258

PCT Pub. Date: Aug. 10, 2017

(65) Prior Publication Data

US 2019/0041031 A1 Feb. 7, 2019

(30) Foreign Application Priority Data

Feb. 4, 2016 (DE) ..... 10 2016 101 999

(51) Int. Cl.
*F21V 7/04* (2006.01)
*F21S 41/19* (2018.01)
(Continued)

(52) U.S. Cl.
CPC ..... *F21V 7/04* (2013.01); *F21S 41/147* (2018.01); *F21S 41/19* (2018.01); *F21S 41/30* (2018.01);
(Continued)

(58) Field of Classification Search
CPC . F21V 7/04; F21V 19/005; F21S 41/30; F21S 41/147; F21S 41/19; F21S 43/14; F21S 43/30; F21S 43/19; F21Y 2115/10
See application file for complete search history.

(56) References Cited

U.S. PATENT DOCUMENTS

2007/0268703 A1* 11/2007 Gasquet ..... F21K 9/00 362/294
2008/0112180 A1* 5/2008 Okada ..... F21S 41/155 362/518
(Continued)

FOREIGN PATENT DOCUMENTS

DE 202007011255 U1 11/2007
DE 102011104055 A1 12/2012
(Continued)

OTHER PUBLICATIONS

Office Action issued in German Patent Application No. 10 2016 101 999.2 dated Sep. 28, 2016.
(Continued)

*Primary Examiner* — Mary Ellen Bowman
(74) *Attorney, Agent, or Firm* — Howard & Howard Attorneys PLLC

(57) ABSTRACT

A light module for a lighting equipment of a motor vehicle including at least one semiconductor light source, which is arranged on a circuit carrier and with a reflector, which is coated with a lacquer and which comprises a mounting section that is coated with the lacquer, which features a broad side and a narrow side and onto which the circuit carrier is attached by a glue connection. The mounting section comprises a surface, out of which projections protrude, which are coated with the lacquer and on which the circuit carrier rests with a distance to the remaining surface of the mounting section and wherein the glue connection is carried out by a glue that is applied next to the projections
(Continued)

or between the projections on at least part of the remaining surface of the mounting section.

12 Claims, 5 Drawing Sheets

(51) Int. Cl.

| | |
|---|---|
| ***F21S 41/147*** | (2018.01) |
| ***F21S 41/30*** | (2018.01) |
| ***F21S 43/19*** | (2018.01) |
| ***F21S 43/14*** | (2018.01) |
| ***F21S 43/30*** | (2018.01) |
| ***F21V 19/00*** | (2006.01) |
| ***F21Y 115/10*** | (2016.01) |

(52) U.S. Cl.
CPC ..... *F21S 43/14* (2018.01); *F21S 43/19* (2018.01); *F21S 43/30* (2018.01); *F21V 19/005* (2013.01); *F21Y 2115/10* (2016.08)

(56) References Cited

U.S. PATENT DOCUMENTS

| | | | | |
|---|---|---|---|---|
| 2009/0080209 | A1* | 3/2009 | Hu | F21V 7/22 362/518 |
| 2010/0202151 | A1 | 8/2010 | Kaak et al. | |
| 2013/0051053 | A1* | 2/2013 | Yasuda | B60Q 1/076 362/516 |
| 2016/0003436 | A1 | 1/2016 | Singer et al. | |
| 2017/0045194 | A1* | 2/2017 | Garcia Castilla | F21S 41/19 |

FOREIGN PATENT DOCUMENTS

| | | | |
|---|---|---|---|
| DE | 102013101262 | A1 | 8/2014 |
| JP | 2012043748 | A | 3/2012 |
| WO | 2009021482 | A1 | 2/2009 |

OTHER PUBLICATIONS

International Search Report and Written Opinion of the International Searching Authority for PCT International Application No. PCT/EP2017/052444 dated May 19, 2017.

* cited by examiner

LIGHT MODULE FOR A MOTOR VEHICLE ILLUMINATION DEVICE

CROSS-REFERENCE TO RELATED APPLICATIONS

The present application is a National Stage of International Patent Application No. PCT/EP2017/052444, filed on Feb. 3, 2017, which claims priority to and all the benefits of German Patent Application No. 10 2016 101 999.2, filed on Feb. 4, 2016, both of which are hereby expressly incorporated herein by reference in their entirety.

BACKGROUND OF THE INVENTION

1. Field of the Invention

The present invention relates to a light module for a lighting equipment of a motor vehicle.

2. Description of the Related Art

Lighting equipment of the type generally known in the related art can include at least one semiconductor light source that is arranged on a circuit carrier and a reflector, wherein the reflector is coated with a lacquer and comprises a mounting section that is also coated with the lacquer, which features a broad side and a narrow side and onto which the circuit carrier is attached to by a glue connection.

The semiconductor light source is e.g. a light diode, and the circuit carrier is e.g. a circuit board or in more general terms, a component, onto which the semiconductor light source can be attached in a mechanical way and which serves for the electric contacting of the semiconductor light source.

The lacquer coating is a several micrometer thick layer, which is to equal out irregularities in the plastic material surface, on which the optical surface is to be produced by metallizing. By means of the metallizing, a high-quality reflection surface is produced. The metal layer for its part is protected by a special protecting layer. The metal layer and the protecting layer for their part and together are significantly thinner than the lacquer coating.

It is currently a common practice that the circuit carrier is glued to the already fully coated and lacquered reflector during the assembling of the lighting equipment. The mounting surface that serves to produce the glue connection has to feature a reproducible quality in order to sufficiently define in particular the position of the semiconductor light source, whose light output area is e.g. only one square millimeter in size. The position, in which the semiconductor light source can be attached in a reproducible manner in series production influences the optical characteristics of the arrangement made up of semiconductor light source and reflector and also depends on e.g. the layer thickness of the lacquer coating on the mounting surface.

Currently, two coating methods are used in the series production. During spray painting, the lacquer is sprayed with tiny drops onto the reflection surface. The drops blend on the reflection surface and a smooth surface appears. Lacquer coatings with very precisely defined thicknesses can be produced in this way. Areas of a component that should not be coated with lacquer can be masked during this procedure.

During a flood coating of lacquer, the object that is to be coated is moved in and through a lacquer veil made of liquid lacquer. The lacquer hereby flows over an edge and over the reflector that is to be coated. The method is very efficient. However, the component is hereby fully covered with lacquer. It cannot be automatically guaranteed though, that the mounting section of the reflector still fulfills the high requirements for a defined layer thickness and evenness of the thickness of the lacquer coating and the glue layer. These disadvantages impair the precision, with which the semiconductor light source can be attached within the reflector and thus result in undesirably high tolerances of the position of the semiconductor light source within the reflector.

SUMMARY OF THE INVENTION

In this context, it is the objective of the present invention to present a lighting equipment that does not features these deficiencies or that only features them to a significantly reduced degree.

The present invention is differentiated from the beforementioned prior art which is known per se and which is taken as a basis. The mounting section therefore comprises a surface, from which projections protrude, which are coated with lacquer and on which the circuit carrier rests with a distance to the remaining surface of the mounting section and the glue connection is carried out by a glue that is applied next to the projections or between the projections on at least part of the remaining surface of the mounting section.

Since the circuit carrier rests on the projections at a distance to the remaining surface of the mounting section, a volume is created between the projections, in which the glue can be accommodated, which is used to carry out the glue connection, without that a thickness of the resulting glue layer affects the position of the semiconductor light source with reference to the reflector. This position is rather determined by the geometry of the projections and the thickness of the lacquer coating that is applied onto the projections, between the projections and onto the circuit carrier.

It has been observed that due to the effect of surface tension, an edge loss of lacquer appears on the projections that rise above the remaining surface of the mounting section. This edge loss has the effect that only a very thin lacquer coating can remain on the projections, whose layer thickness is largely independent from the layer thickness of the lacquer coating within the areas of the mounting section that is adjacent to the projections. Due to this reason, the precision of the position of the circuit carrier that rests on the projections is also largely independent from the layer thickness of the lacquer coating within the areas of the mounting section that are adjacent to the projections. The end result is that there is a small fluctuation margin of the positions of the circuit carriers in the reflectors. This advantage appears automatically and without additional effort as an effect of the edge loss of the lacquer on the projections.

In one embodiment, the surface is part of a broad side of the mounting section.

The narrow side of the mounting section may also include at least one projection that protrudes from the narrow side, which is coated with lacquer and onto which the circuit carrier rests against.

The projections may also include a shape with reference to the perpendicular cross section of the remaining surface of the broad side and/or the remaining narrow side, which shape is composed of the rectangular or trapezoid base and a convex curvature that adjoins this base. The convex curvature without any step and edge merges into the base.

The convex curvature may include the shape of a circular arc.

The projection may include a line shape in a top view.

In one embodiment, the projection features a longitudinal direction that extends parallel to the surface out of which is protrudes and perpendicular to its height and a width that is parallel to the surface, perpendicular to the height and perpendicular to the longitudinal direction, wherein its length in longitudinal direction is at least five times as long as its width.

The projection may feature a point or circular shape in a top view.

The projection may also include a truncated cone-shaped base and a distal end in the form of a convex ball segment that merges into the base.

In one embodiment, a height of the projection ranges between 0.6 mm and 1 mm and that its width ranges between 0.8 and 1.5 mm at it widest point.

In one embodiment, the radius of the circle section amounts to 0.3-0.6 mm and that a height of the base is 0.8 to 1.2 times of the height of the convex curvature.

Further advantages can be derived from the dependent claims, the description and the attached figures.

It is understood, that the presently mentioned characteristics as well as those that are still to be described in the following cannot only be used in the respectively mentioned combination, but also in other combinations or individually, without leaving the framework of the present invention.

BRIEF DESCRIPTION OF THE DRAWINGS

Embodiments of the invention are depicted in the drawings and are explained in more detail in the following description. Hereby, the same reference signs in the various figures describe elements that are respectively equal or at least comparable in their functionality. It is shown, in schematic form respectively.

DETAILED DESCRIPTION OF THE INVENTION

Figure 1:
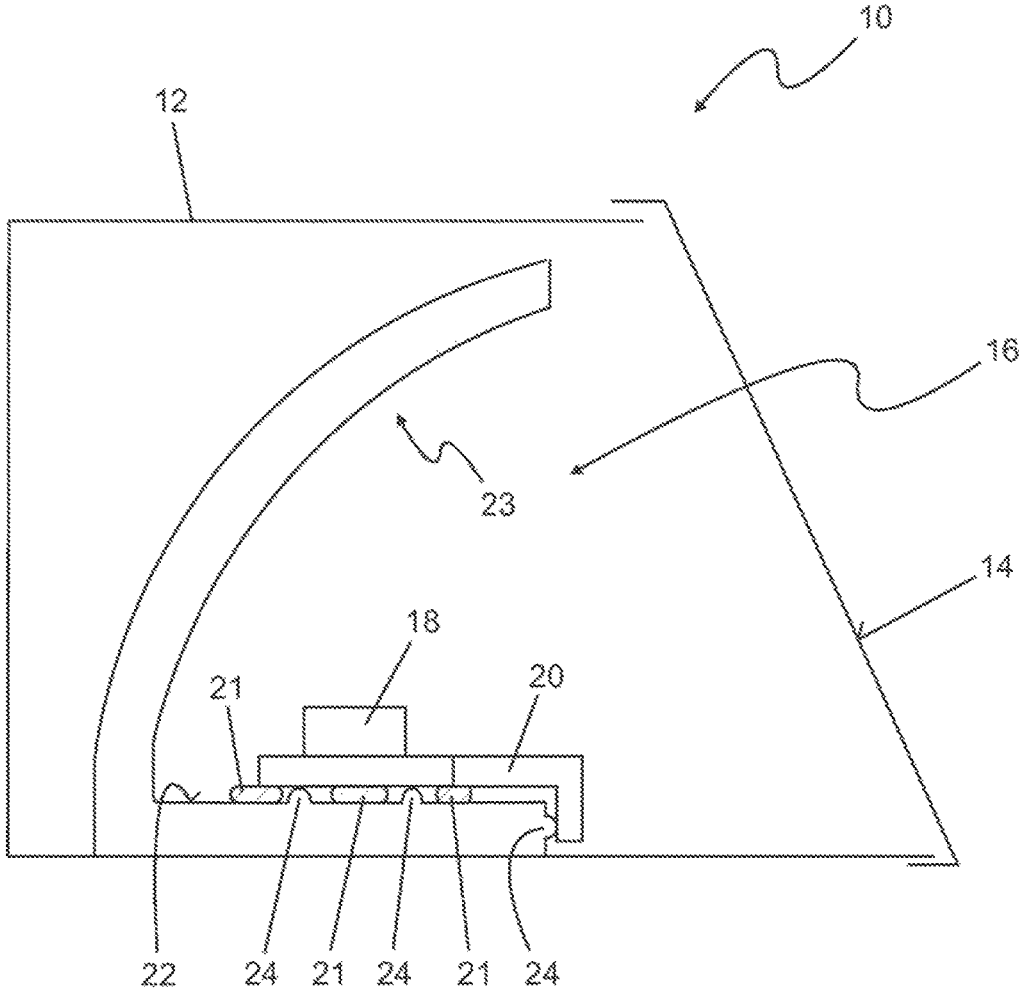
FIG. 1 shows the technical environment of the invention in form of a sectional view of a motor vehicle lighting device.

In detail, FIG. 1 depicts a lighting equipment of a motor vehicle 10 comprising a housing 12, whose light output area is covered by a transparent cover screen 14. A light module 16 is arranged within the housing. Light module 16 comprises a semiconductor light source 18, which is attached onto a circuit carrier 20. Circuit carrier 20 is connected to the mounting section 22 of a reflector 23 by a glue connection 21. Reflector 23 features projections 24 within its mounting section 22, on which circuit carrier 20 rests. In its rested condition, circuit carrier 20 is located in a pre-determined position with reference to reflector 23. Circuit carrier 20 is held in this location by a glue connection 21.

Figure 2:
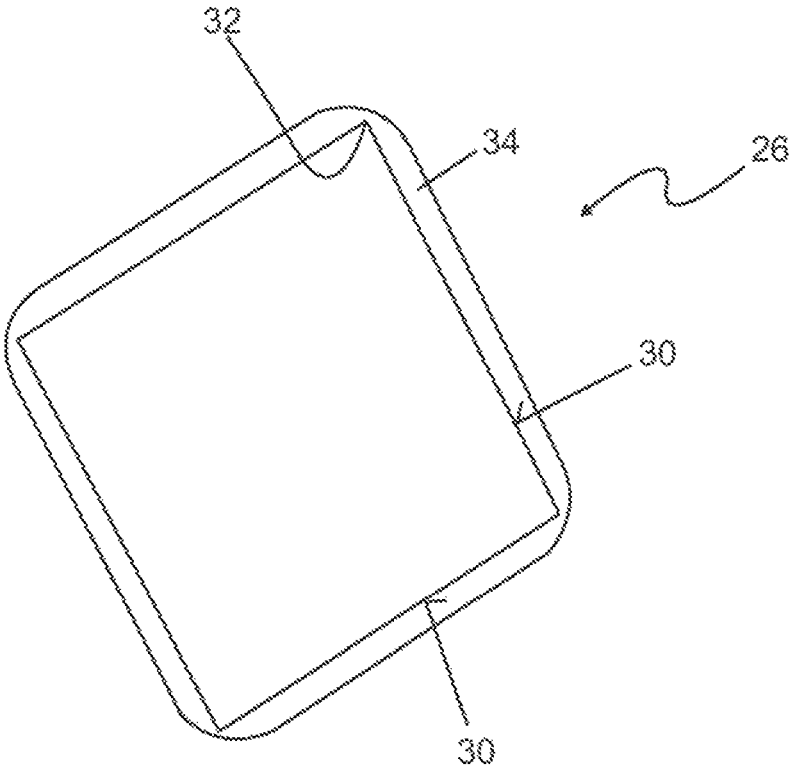
FIG. 2 shows a cross section of a lacquered cuboid to explain an effect that is used in the invention.

FIG. 2 illustrates the effect of the edge loss that is used for the invention. Therefore, FIG. 2 depicts a cross section of a cuboid 26, which features a surface. The cuboid extends in perpendicular direction with reference to the drawings plane. The side areas 30 of the cuboid appear as edges in FIG. 2, and the edges 32 of the cuboid, that are situated between the side areas, appear as corners in FIG. 2. In the following, it is assumed that the cuboid features the same surface quality as reflector 22 before the lacquer coating is applied, so that the same surface tension is reached in the system surface/lacquer.

The lacquer coating 34 that needs to be applied can be a first smoothening lacquer coating, which smoothens irregularities in the reflection surface of the reflector that is preferably made out of plastic material or metal.

However, the lacquer coating 34 that is to be applied can be a transparent cover layer, that is to protect a high gloss metal reflection layer of the reflector against mechanical damaging due to scratches and/or corrosion.

When the lacquer coating 34 is applied, a significantly thinner lacquer coating thickness appears on the edges 32 than on the lacquered surfaces 30 that are adjacent to the edges 32. This phenomenon results due to the surface tension of the lacquer coating, which in a sense pulls the lacquer away from the edges. This effect is also referred to as edge loss in this application. This effect occurs in particular with lacquer coatings that are based on the solvent ethyl acetate. The use of such lacquer coatings for reflectors in lighting equipment of motor vehicles is common.

The thickness of the lacquer coating that remains on the edges 32 is largely independent from the thickness of the lacquer coating 34, which appears on the considered surface 30 that is adjacent to edge 32.

This means in particular that the position of a circuit carrier 20, which rests on such edges 32, is largely independent from the thickness of the lacquer coating 34 on the mentioned surfaces 30. Thus, fluctuations in the thickness of this coating, which can occur from reflector to reflector when the reflectors are lacquered, do not impair the accuracy of the position of the circuit carriers that are to be glued on afterwards.

Figure 3:
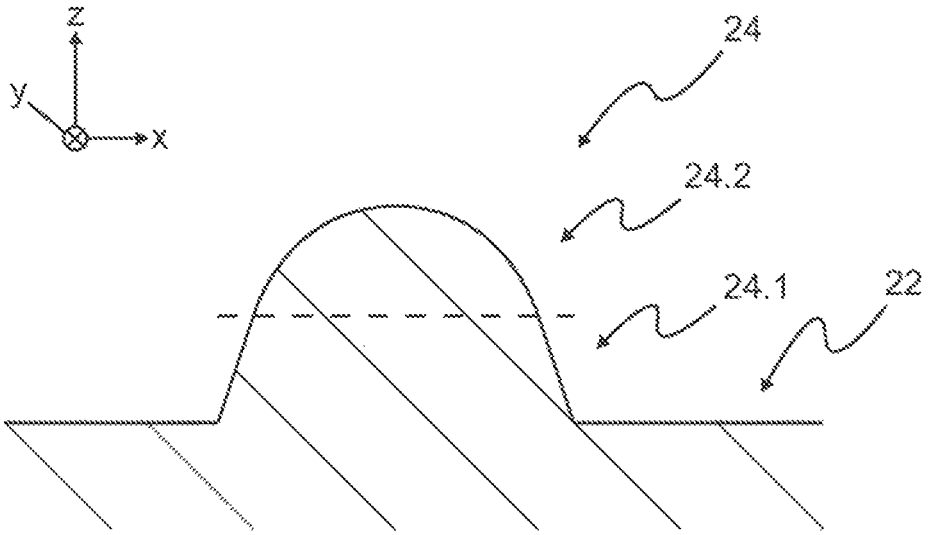
FIG. 3 shows a portion from a mounting section of a reflector that features characteristics of the invention.

FIG. 3 depicts a cross section of a projection, which protrudes out of a surface from a mounting section 22. The surface of the mounting surface is to be an x-y plane of a right-handed and orthogonal coordinate system. The direction, into which the projection 24 protrudes out of the surface, thus refers to the z-direction. If such a projection 24 along with the adjacent surface is covered with a lacquer coating, the surface tension mainly appears in the drawing plane, which is the x-z plane in the represented case.

In this plane, the shape of the projection is made up by a base 24.1 and a dome 24.2 with a convex curvature. In one embodiment, base 24.1 features the shape of a rectangle, as it is depicted in this case, the shape of a trapezoid, whose shorter side is facing towards dome 24.2. The dome preferably features a cross section in the shape of a circle section.

In one embodiment, the expansion of the projection in the y-direction, which is perpendicular to the drawing plane, is larger by the factor five than the expansion in the x-direction, which is located within the drawing plane. Reference is thus made to a rib-like projection, whose distal end, starting from the base, features the shape of a convex cylinder segment with a circle section shaped base.

In a top view (viewing direction: minus z-direction) such a projection features a line shape.

In another embodiment, the projection comprises a truncated cone-shaped base and a distal end in form of a convex ball segment that merges into the base. To differentiate with regards to the rib-shaped projections, these projections can be referred to as mounting points.

In a top view, such a projection features a circular shape or a point shape.

It is also preferred that the dome merges into the base without any step and with a steady curvature in a tangentially constant manner. The height of the projection that is to be measured in z-direction preferably ranges between 0.6 mm and 1 mm. Its width ranges between 0.8 and 1.5 mm at it widest point. In a dome that is shaped in a circle section, the radius of the circle section preferably amounts to 0.3-0.6 mm. The height of the base that is limited in a straight line preferably is 0.8 to 1.2 times of the height of the dome with the convex curvature.

Figure 4:
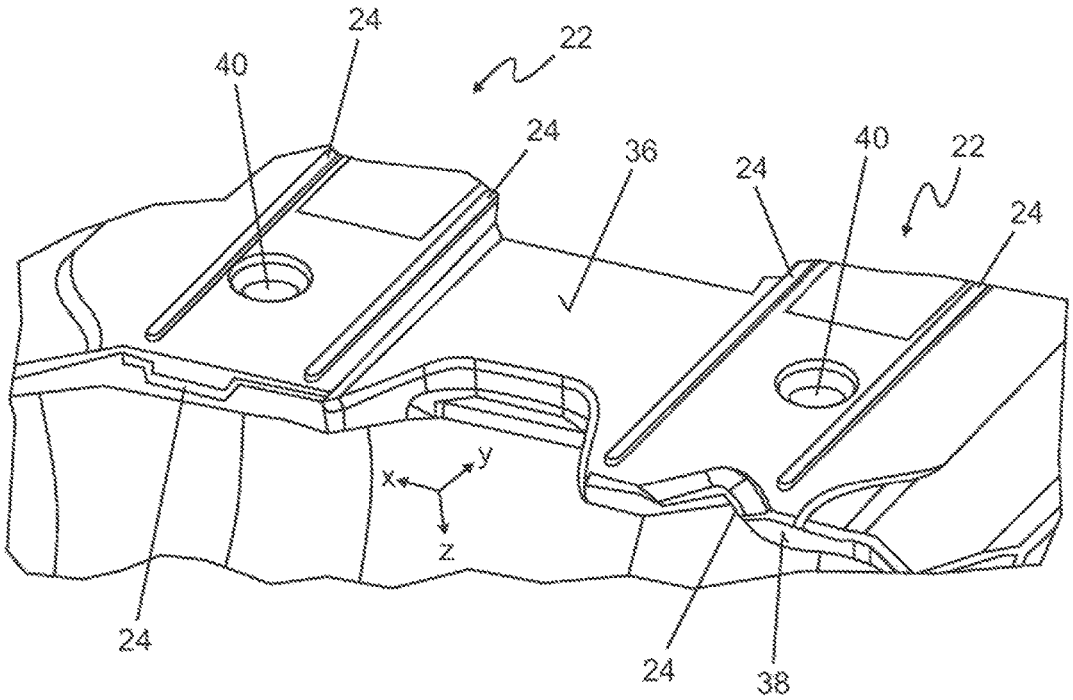
FIG. 4 shows a portion from a mounting section of another reflector that features characteristics of the invention.

FIG. 4 shows mounting sections of a reflector 23 of an embodiment of a lighting equipment according to the invention. In addition to the mounting sections, the reflector particularly features a reflection surface.

A first mounting section 22 features a first surface 36 that is parallel to an x-y plane in this case, and it features a second surface 38 that is parallel to an x-z plane in this case. The first surface is a broad side of the mounting section, and the second surface is a narrow side of the mounting section. First projections 24 protrude out of the first surface. The first projections 24 feature a respective cross section (in x-z direction) as it is depicted in FIG. 3. In a direction that is perpendicular to this cross section the projections feature the form of elongated lines. The lines do not run in one alignment, but they rather run with a distance towards each other, so that they define a plane. The projections 24 hereby respectively protrude to such an extent out of the surface of the remaining mounting section 22, that their lines, which are farthest away from the remaining surface of the mounting section, run in one plane. The plane forms a mounting plane for circuit carrier 20. Circuit carrier 20 rests within this plane on the projections and is thus fixed in the z-direction.

Further projections 24 protrude out of the second surface and thus form a respective limit stop in the y-direction for a circuit-carrier, which has a contact surface that is parallel to the x-z plane.

The second mounting section is differentiated from the first mounting section in that it features a V-shaped notch, which is designed to accommodate a pin that is protruding out of a circuit carrier. In this way, it is possible to align a circuit carrier, which generally rests on the elongated ribs, in a centered manner in the x-direction as well. The openings 40 in the mounting sections serves to illuminate the reflection surface 42 with the light from a semiconductor light source that is arranged on the circuit carrier.

Figure 5:
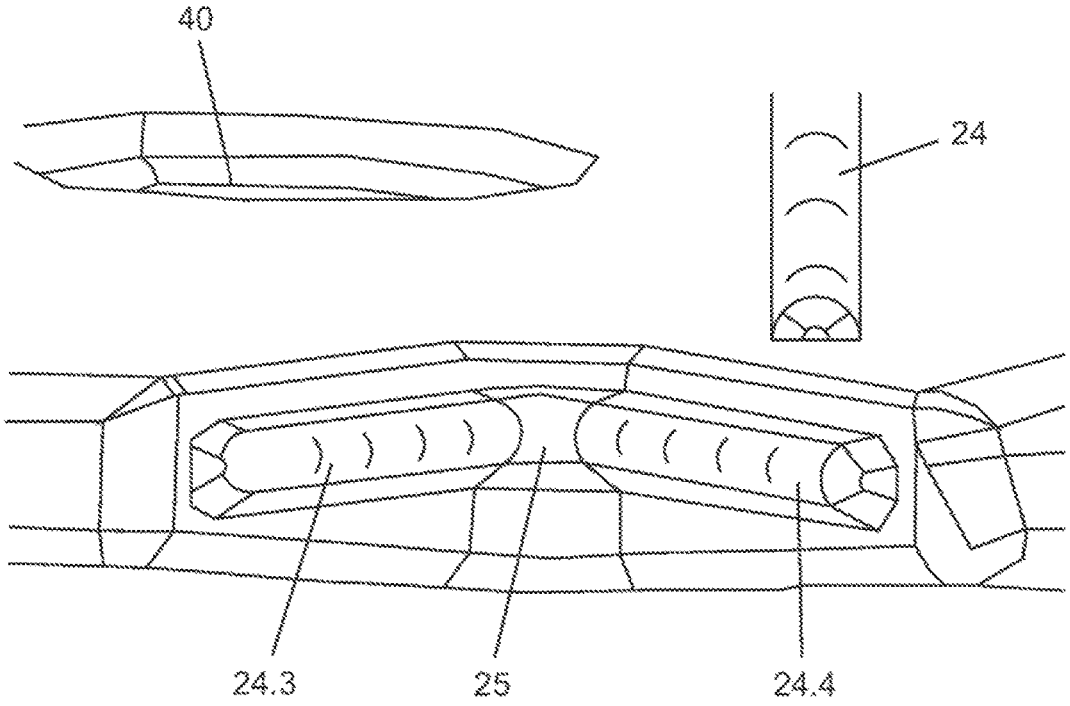
FIG. 5 shows a portion from a reflector that features characteristics of the invention.

FIG. 5 depicts one embodiment of a V-shaped notch within the second surface 38 (also the narrow side) of the second mounting section from FIG. 4. In this case, an elongated projection 24 protrudes out of the second surface as well. This projection features two elongated sections 24.3, 24.4, which extend in a straight line and which are aligned in V-shape. In the tip of the thus formed V-shape, these two sections are connected by a section 25, which is bent in that space that is limited by a saddle surface. The saddle surface respectively merges in a continuous manner and with a steady curvature into the cylinder barrel shaped convex limit surface of the elongated sections.

This shape facilitates an equally thin lacquer thickness that is also achieved in the tip of the V-shape, which contributes to the desired position accuracy.

At their open ends, the rib-shaped and line-like expanding projections 24 are preferably rounded in a respectively convex manner. The convex surfaces hereby merge in a continuous manner and with a steady curvature into adjacent surfaces of the projections which are limited in a straight line. However, the shape of the transitions between the surface, out of which the projections protrude, and the projections, are of secondary importance since they do not influence the precision with which a circuit carrier can be positioned respectively.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A light module for a lighting equipment of a motor vehicle, comprising at least one semiconductor light source, which is arranged on a circuit carrier and with a reflector, which is coated with a lacquer and which comprises a mounting section that is coated with the lacquer, which features a broad side and a narrow side and onto which the circuit carrier is attached by a glue connection, wherein the mounting section comprises a surface, out of which projections protrude, which are coated with lacquer and on which the circuit carrier rests with a distance to the remaining surface of the mounting section and wherein the glue connection is carried out by a glue that is applied next to the projections or between the projections on at least part of the remaining surface of the mounting section.

2. The light module as set forth in claim 1, wherein the surface is part of a broad side of the mounting section.

3. The light module as set forth in claim 2, wherein the narrow side of the mounting section features at least one projection that protrudes from the narrow side, which is coated with lacquer and onto which the circuit carrier rests against.

4. The light module as set forth in claim 2, wherein the projections feature a shape with reference to the perpendicular cross section of the remaining surface of the broad side and/or the remaining narrow side, which shape is composed of the rectangular or trapezoid base and a convex curvature that adjoins this base.

5. The light module as set forth in claim 4, wherein the convex curvature merges into the base without any step and without any edge.

6. The light module as set forth in claim 5, wherein the convex curvature features the shape of a circular arc.

7. The light module as set forth in claim 1, wherein the projection features a line shape in a top view.

8. The light module as set forth in claim 7, wherein the projection features a longitudinal direction that extends parallel to the surface out of which is protrudes and perpendicular to its height and a width that is parallel to the surface, perpendicular to the height and perpendicular to the longitudinal direction, wherein its length in longitudinal direction is at least five times as long as its width.

9. The light module as set forth in claim 1, wherein the projection features a point or circular shape in a top view.

10. The light module as set forth in claim 9, wherein the projection comprises a truncated cone-shaped base and a distal end in the shape of a convex ball segment that merges into the base.

11. The light module as set forth in claim 1, wherein a height of the projection ranges between 0.6 mm and 1 mm and that its width ranges between 0.8 and 1.5 mm at it widest point.

12. The light module as set forth in claim 6, wherein the radius of the circle section amounts to 0.3-0.6 mm and that a height of the base is 0.8 to 1.2 times of the height of the convex curvature.

* * * * *